US012352438B2

(12) United States Patent
Iwamoto et al.

(10) Patent No.: US 12,352,438 B2
(45) Date of Patent: Jul. 8, 2025

(54) AIR BLOWER AND COMBUSTION DEVICE INCLUDING THE SAME

(71) Applicant: NORITZ CORPORATION, Hyogo (JP)

(72) Inventors: Mikihiro Iwamoto, Hyogo (JP); Ryosuke Umakoshi, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 370 days.

(21) Appl. No.: 18/076,395

(22) Filed: Dec. 7, 2022

(65) Prior Publication Data

US 2023/0280030 A1 Sep. 7, 2023

(30) Foreign Application Priority Data

Dec. 23, 2021 (JP) ..... 2021-209126

(51) Int. Cl.
*F04D 29/66* (2006.01)
*F04D 17/16* (2006.01)
*F23L 5/02* (2006.01)

(52) U.S. Cl.
CPC ..... *F23L 5/02* (2013.01); *F04D 17/16* (2013.01); *F04D 29/666* (2013.01)

(58) Field of Classification Search
CPC ..... F04D 29/384; F04D 29/666; F23L 5/02
See application file for complete search history.

(56) References Cited

U.S. PATENT DOCUMENTS

2013/0052001 A1* 2/2013 Su ..... F04D 25/0613 415/203
2015/0330223 A1* 11/2015 Choi ..... F01D 15/005 417/424.2
2020/0370562 A1* 11/2020 Lee ..... F04D 29/384

FOREIGN PATENT DOCUMENTS

| | | |
|---|---|---|
| JP | 2010133254 | 6/2010 |
| JP | 2017110526 | 6/2017 |
| JP | 2017150472 | 8/2017 |
| JP | 2020133495 | 8/2020 |

OTHER PUBLICATIONS

Fukunishi, JP 2017150472 A English Translation, 2017 (Year: 2017).*

* cited by examiner

*Primary Examiner* — Michael L Sehn
(74) *Attorney, Agent, or Firm* — JCIPRNET

(57) ABSTRACT

An air blower and a combustion device including the air blower are provided.
An air blower includes an impeller housed in a casing and rotating. The impeller includes multiple blades to form multiple inter-blade passages, and a central space portion. When the impeller rotates, air flowing into the central space portion through an air intake port of the casing passes through the inter-blade passages at an outward side. To reduce noise generated when the air passes through the inter-blade passages, each blade includes: multiple first concavo-convex portions, with a first surface side being concave and a second surface side on the other side being convex, from among a first and a second surface corresponding to a front and a rear surface of each blade; and multiple second concavo-convex portions, with the second surface side being concave and the first surface side being convex, contrary to the first concavo-convex portions.

20 Claims, 6 Drawing Sheets

AIR BLOWER AND COMBUSTION DEVICE INCLUDING THE SAME

CROSS-REFERENCE TO RELATED APPLICATION

This application claims the priority benefits of Japanese application no. 2021-209126, filed on Dec. 23, 2021. The entirety of the above-mentioned patent application is hereby incorporated by reference herein and made a part of this specification.

BACKGROUND

Technical Field

The disclosure relates to an air blower such as a centrifugal air blower and a combustion device including the same.

Related Art

The applicant of the application has previously proposed the device described in Patent Literatures 1-3 (JP-A-2017-110526, JP-A-2017-150472, JP-A-2020-133495) as a specific example of the air blower.

In the air blowers described in these Literatures, an impeller is housed in a casing and is driven by a motor to rotate freely. The casing has an air intake port and an air blowing port. The impeller has a plurality of blades arranged at intervals in a circumferential direction, and a region closer to a center than the plurality of blades serves as a central space portion communicating with inter-blade passages formed in between the plurality of blades. When the impeller rotates, air flowing into the central space portion of the impeller from outside of the casing through the air intake port flows to outer periphery of the impeller through the inter-blade passages then reaches the air blowing port, and is discharged from the air blowing port to the outside of the casing.

However, in the aforementioned prior art, there is room for improvement as follows.

Quietness (low noise) is often required as a performance of air blowers. In contrast, the air blower having the above-described configuration makes use of centrifugal force generated when the plurality of blades of the impeller rotate, and forcibly causes the air to flow in the inter-blade passages of the impeller to the outer periphery of the impeller, the noise caused by the airflow is relatively loud, therefore improvement is desired.

Patent Literature 4 (JP-A-2010-133254) recites means for providing dimples on one side of each blade of the impeller for reducing the noise as described above. According to such means, when air flows along the one side of each blade, it is possible to generate small-scale turbulence at the dimple formation locations, suppress the airflow from separating from the one side, and reduce blowing noise caused by the separation of the airflow. However, it is difficult to achieve sufficient quietness with only such an effect, and it is desired to further enhance the noise reduction effect.

The disclosure has been conceived under the circumstances as described above, and an object of the disclosure is to provide an air blower capable of appropriately reducing noise, and a combustion device including the same.

In order to solve the above problems, the disclosure takes the following technical means.

SUMMARY

The air blower according to the first aspect of the disclosure includes a casing, having an air intake port and an air blowing port, and an impeller housed in the casing and rotating. The impeller includes a plurality of blades arranged at intervals in a circumferential direction so as to form a plurality of inter-blade passages, and a region closer to a center than the plurality of blades serves as a central space portion communicating with the plurality of inter-blade passages. When the impeller rotates, air that flowing into the central space portion through the air intake port pass through the plurality of inter-blade passages at a radially outward side of the impeller. To reduce noise generated when the air passes through the plurality of inter-blade passages, each of the blades includes: a plurality of first concavo-convex portions, with a first surface side being concave and a second surface side on the other side being convex, from among a first surface and a second surface corresponding to a front surface and a rear surface of each of the blades; and a plurality of second concavo-convex portions, with the second surface side being concave and the first surface side being convex, contrary to the first concavo-convex portions.

In the disclosure, preferably, each blade is configured using a metal plate, and each of the first concavo-convex portions and the second concavo-convex portions is a press-worked portion.

In the disclosure, preferably, each of the first concavo-convex portions and the second concavo-convex portions has a concave spherical surface on one side and a convex spherical surface on an opposite side. A region of the concave spherical surface has a circular shape having a diameter of 1.0 to 3.0 mm when viewed from the front, and a depth of a deepest portion is 0.4 mm or more.

In the disclosure, preferably, the plurality of first concavo-convex portions and the plurality of second concavo-convex portions are arranged in a plurality of rows in a radial direction and a with direction of the impeller intersecting each other, and the rows of the first concavo-convex portions and the rows of the second concavo-convex portions are staggered and alternately arranged in the radial direction and the width direction.

In the disclosure, preferably, a total frontal view projection area of the plurality of first concavo-convex portions and the plurality of second concavo-convex portions in each of the blades is larger than a total area of non-concavo-convex portions interposed between the plurality of first concavo-convex portions and the plurality of second concavo-convex portions.

In the disclosure, preferably, a total frontal view projection area of the plurality of first concavo-convex portions and the plurality of second concavo-convex portions in each of the blades plus the non-concavo-convex portions interposed therebetween exceeds half of an area of each of the first and second surfaces of each of the blades.

In the disclosure, preferably, the impeller further includes: a plurality of auxiliary blades positioned radially outward of the impeller in between the plurality of blades and dividing the inter-blade passages into a plurality of regions in the circumferential direction. The plurality of the first concavo-convex portions and the plurality of second concavo-convex portions are also provided on each of the auxiliary blades.

A combustion device according to the second aspect of the disclosure includes a burner and an air blower for supplying gas for combustion to the burner. The air blower according to the first aspect of the disclosure is configured as the air blower.

Figure 5:
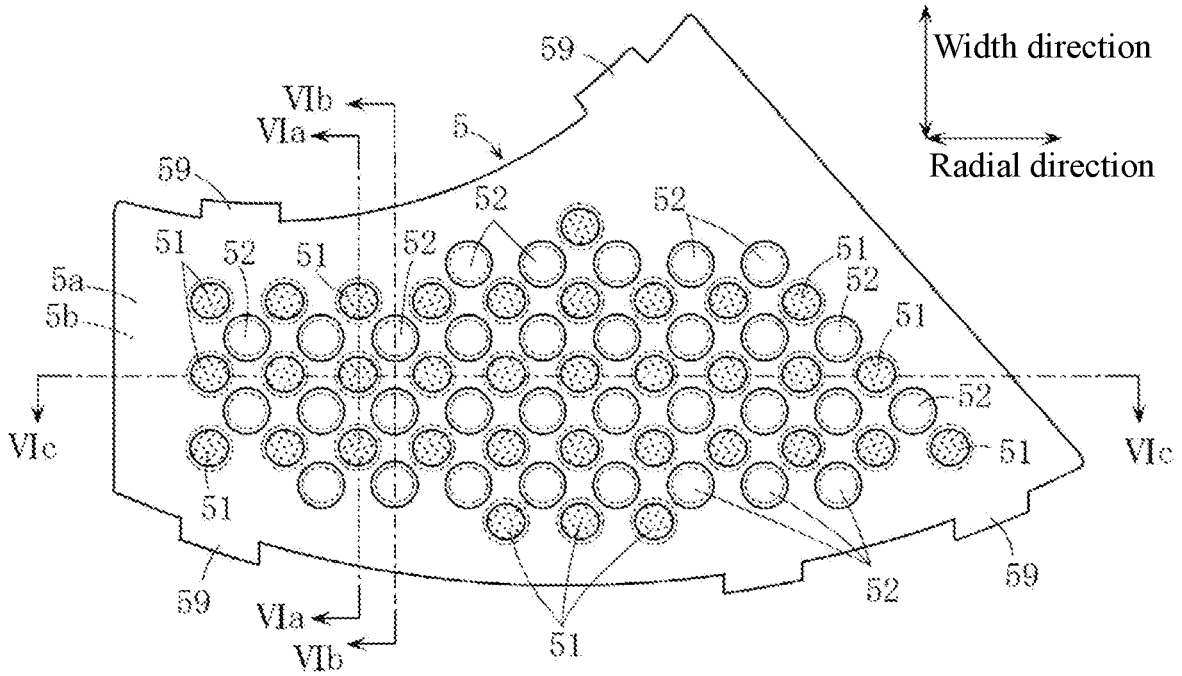
FIG. 5 is a front view of a blade of the impeller shown in FIGS. 3 and 4.
Figure 6:
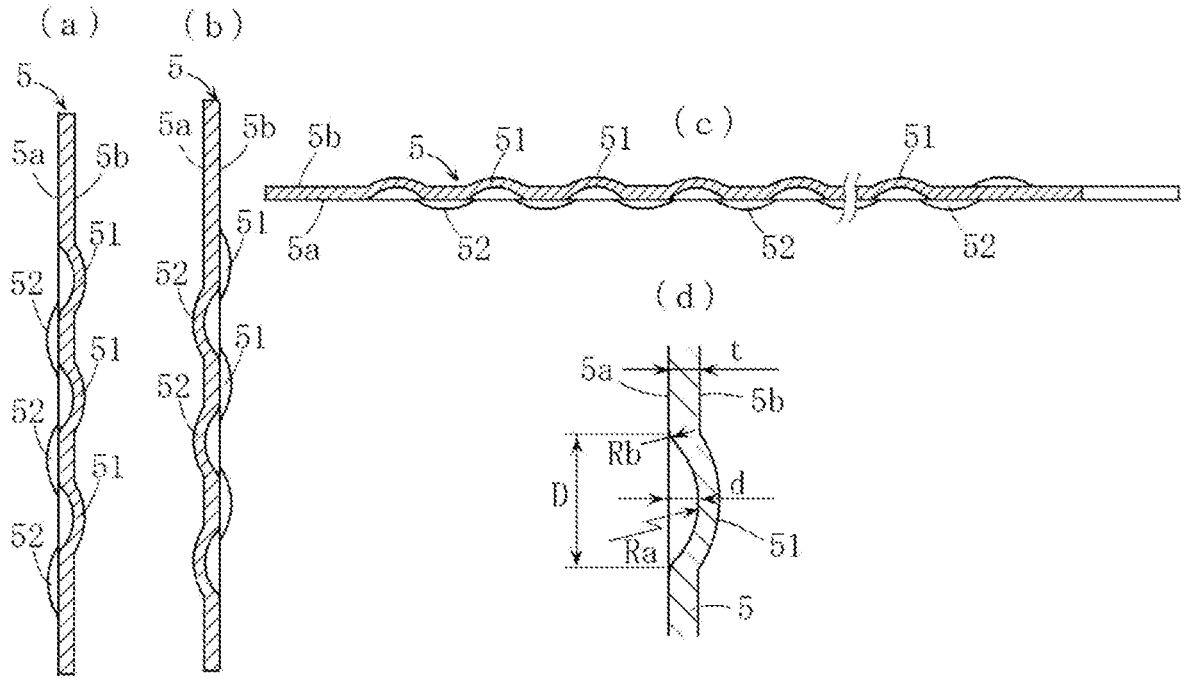

(a) of FIG. 6 is a sectional view taken along line VIa-VIa in FIG. 5; (b) of FIG. 6 is a sectional view taken along line VIb-VIb in FIG. 5; (c) of FIG. 6 is a sectional view taken along line VIc-VIc in FIG. 5; and (d) of FIG. 6 is a partially enlarged sectional view of (a) of FIG. 6.

Figure 1:
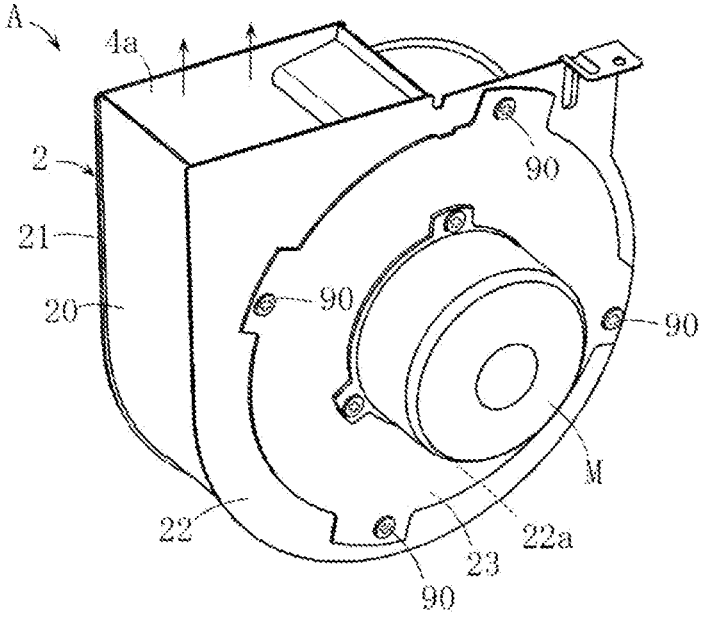
FIG. 1 is a perspective view showing an example of an air blower according to the disclosure.
Figure 2:
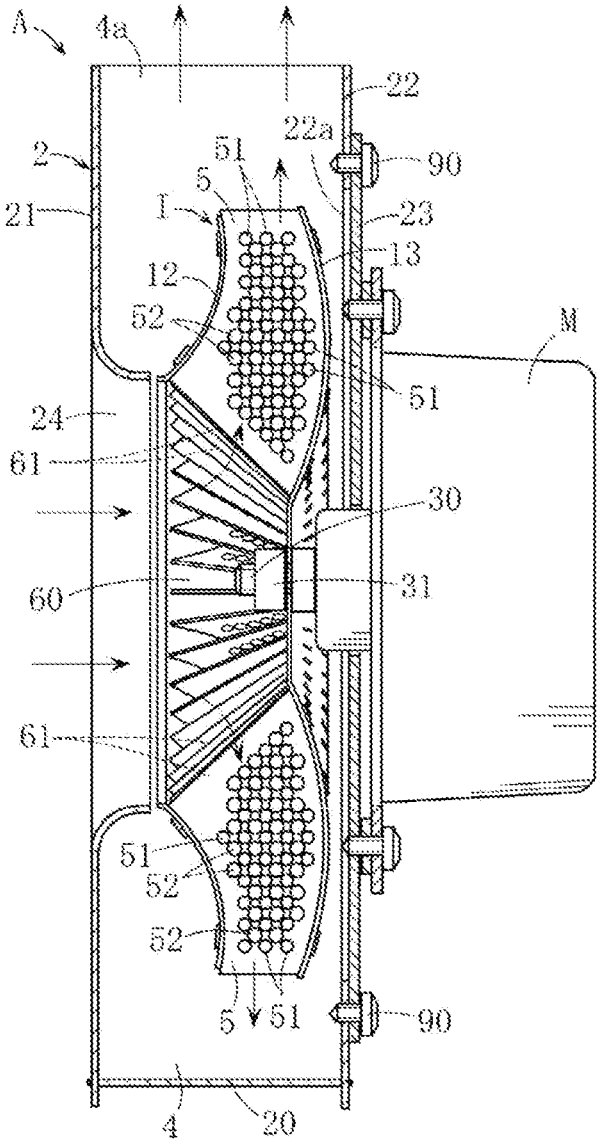
FIG. 2 is a cross-sectional view of the air blower shown in FIG. 1.
Figure 7:
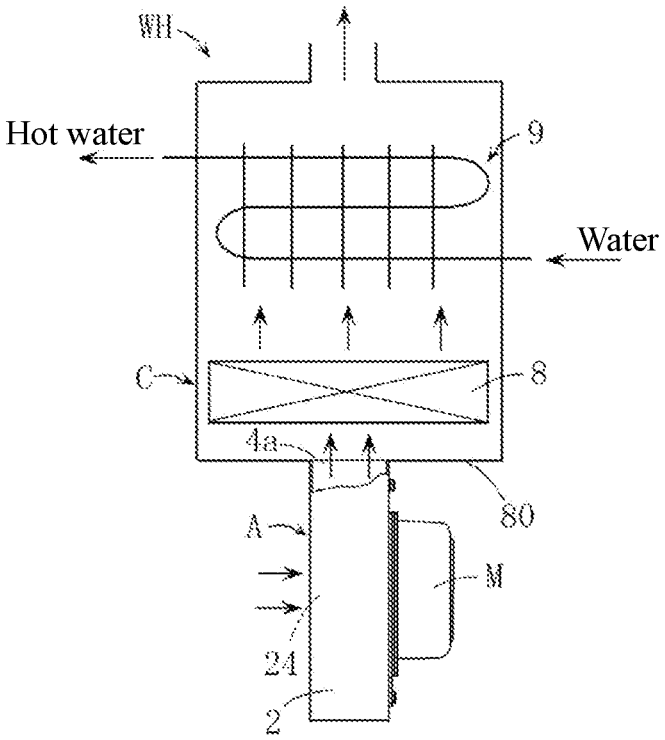

FIG. 7 is a cross-sectional view of main portions showing an example of a combustion device configured with the air blower shown in FIGS. 1 and 2 and a hot water supply device configured using this combustion device.

Figure 8:
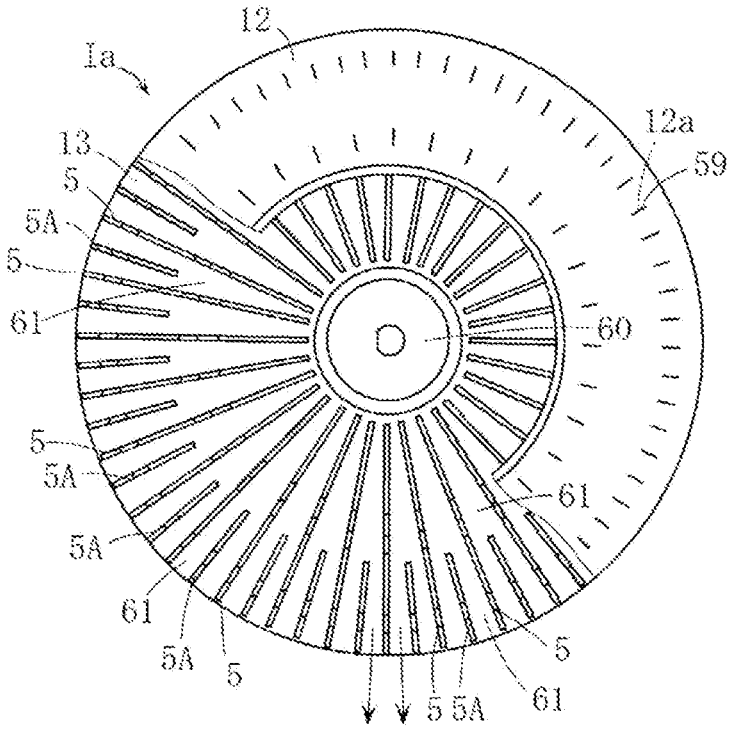

FIG. 8 is a partially cutaway plan view showing another example of an impeller according to the disclosure.

Figure 9:
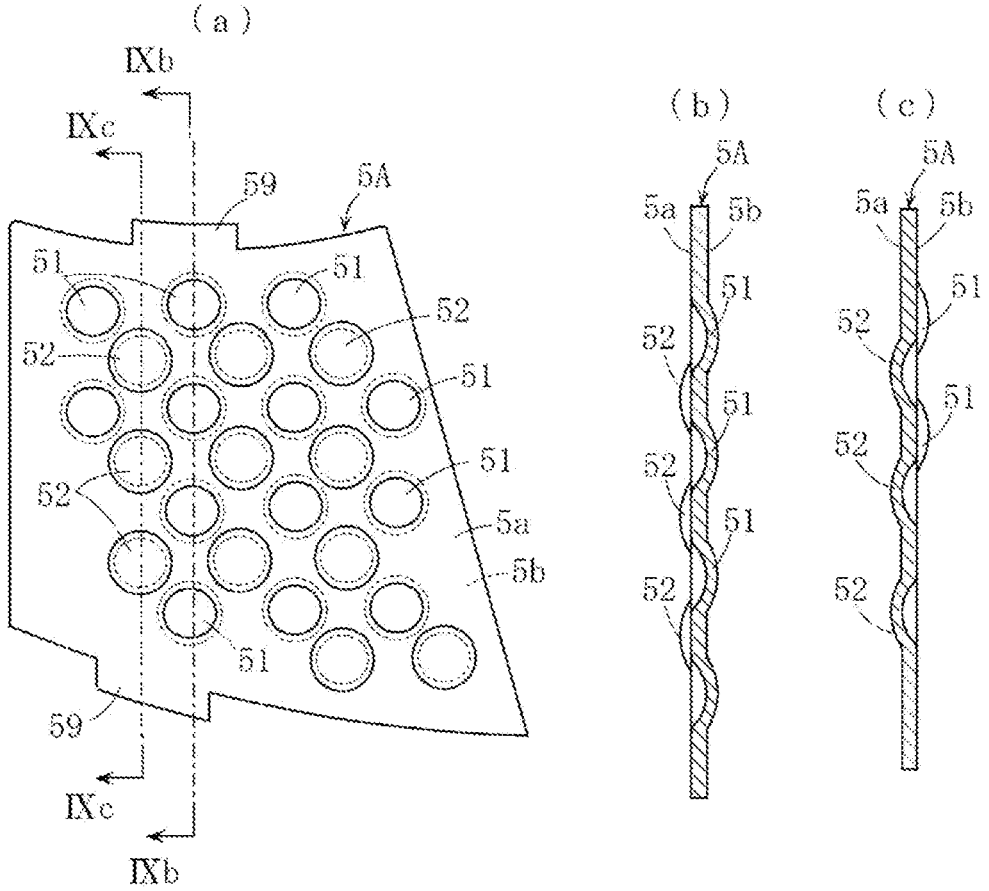

(a) of FIG. 9 is a front view of an auxiliary blade of the impeller shown in FIG. 8; (b) of FIG. 9 is a cross-sectional view taken along line IXb-IXb of (a) of FIG. 9; and (c) of FIG. 9 is a cross-sectional view along IXc-IXc of (a) of FIG. 9.

DESCRIPTION OF THE EMBODIMENTS

According to such a configuration, the following effects can be achieved.

That is, each blade of the impeller includes a plurality of first concavo-convex portions and a plurality of second concavo-convex portions, in which one side thereof, of the front surface and the rear surface (the first surface and the second surface), is concave and the other side is convex. In one concave region, a so-called dimple effect occurs, such that separation of the air flow can be suppressed and Karman vortex can be suppressed. In the other convex region, an effect similar to or close to the dimple effect of the concave region may also be brought forth. Thereby, the noise generated when the impeller rotates and the air flows through the inter-blade passages can be reduced by the presence of the plurality of first concavo-convex portions and the plurality of second concavo-convex portions, in which plurality of first and second concavo-convex portions are provided on two surfaces (first and second surfaces) of each blade of the impeller. For this reason, compared with Patent Literature 4 in which dimples are provided only on one side, for example, the noise reduction effect can be improved, and quietness can be enhanced.

Further, according to the disclosure, the cross-sectional shapes of the first concavo-convex portions and the second concavo-convex portions provided on each blade may be symmetrical or nearly symmetrical. Thus, it is possible to prevent warping deformation and the like from occurring in each blade, and to accurately maintain the shape of each blade. Unlike the disclosure, for example, when each blade includes only the first concavo-convex portions, each blade has only concave regions on the first surface and only convex regions on the second surface, and warping deformation and the like are likely to occur. According to the disclosure, such problems can be appropriately avoided.

According to such a configuration, the first concavo-convex portions and the second concavo-convex portions of each blade may be formed relatively easily by press-working. Since press-working is performed on two surfaces (first and second surfaces) of each blade, it is possible to prevent warping deformation from occurring in each blade.

The inventors carried out experiments repeatedly for the relationship between the shapes and sizes of the first concavo-convex portions and the second concavo-convex portions and the noise reduction effect, and found that the noise reduction effect is better according to the above configuration. This may also be understood from the description to be described later with reference to Table 1.

According to such a configuration, the plurality of first concavo-convex portions and the plurality of second concavo-convex portions provided on each blade of the impeller are provided in an arrangement that effectively acts on the airflow in the inter-blade passages, which is more preferable for enhancing the noise reduction effect.

According to such a configuration, the plurality of first concavo-convex portions and the plurality of second concavo-convex portions are provided at a high density such that the area of the non-concavo-convex portions interposed between the plurality of first concavo-convex portions and the plurality of second concavo-convex portions is smaller. Thus, it is possible to further enhance the noise reduction effect using the first concavo-convex portions and the second concavo-convex portions.

According to such a configuration, the plurality of first concavo-convex portions and the plurality of second concavo-convex portions are provided over a wide range of each blade, therefore a sufficient noise reduction effect can be expected.

According to such a configuration, the following effects are obtained.

That is, when the plurality of blades of the impeller are radially provided, for example, the inter-blade passages are wider at the radially outward position of the impeller. Thus, when the air flows in the width portion of the inter-blade passages, the amount of air that does not flow near the two surfaces (first and second surfaces) of each blade and does not flow near the formation locations of the first concavo-convex portions and the second concavo-convex portions increases, which may cause noise. On the other hand, according to the above configuration, by providing the auxiliary blades at where such airflow occurs, it is possible to further obtain a noise reduction effect using the first concavo-convex portions and the second concavo-convex portions provided on the auxiliary blades.

According to such a configuration, the same effect as described for the air blower according to the first aspect of the disclosure can be obtained.

Other features and advantages of the disclosure will be further illustrated by the following description of embodiments of the disclosure with reference to the accompanying drawings.

Preferred embodiments of the disclosure will be specifically described below with reference to the drawings.

An air blower A shown in FIGS. 1 and 2 is of a centrifugal type, and includes an impeller I, a casing 2 that houses the impeller I, and a motor M that drives and rotates the impeller I. Each of blades 5 of the impeller I includes a plurality of first concavo-convex portions 51 and a plurality of second concavo-convex portions 52 (stepped portions), which will be described later.

The casing 2 includes a front wall portion 21 formed with an air intake port 24, a rear wall portion 22 facing the front wall portion 21 at a distance, and a peripheral wall portion 20. A motor mounting plate 23 to which the motor M is screwed is attached to the rear wall portion 22 using screws 90. The motor mounting plate 23 blocks an opening 22*a* for taking in and out the impeller I provided in the rear wall portion 22. The peripheral wall portion 20 surrounds an outer periphery of the impeller I, and the air blowing port 4*a* is formed in its upper portion. An air passage 4 of the impeller I is formed between the outer periphery of the impeller I and the peripheral wall portion 20 to guide the air flowing out from inter-blade passages 61 (to be described later) to the air blowing port 4*a*.

Figure 3:
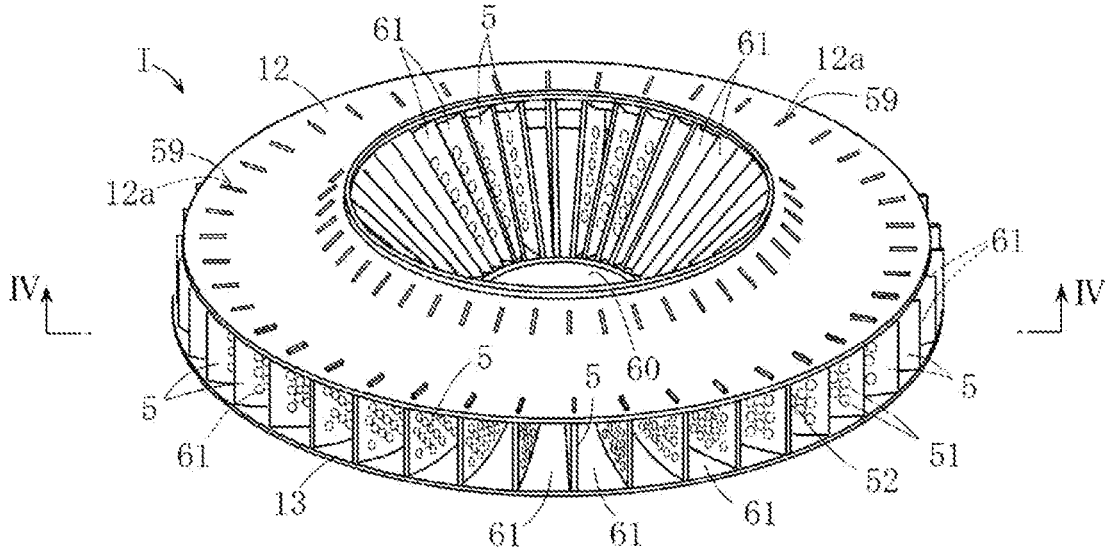
FIG. 3 is a perspective view of an impeller of the air blower shown in FIG. 1.
Figure 4:
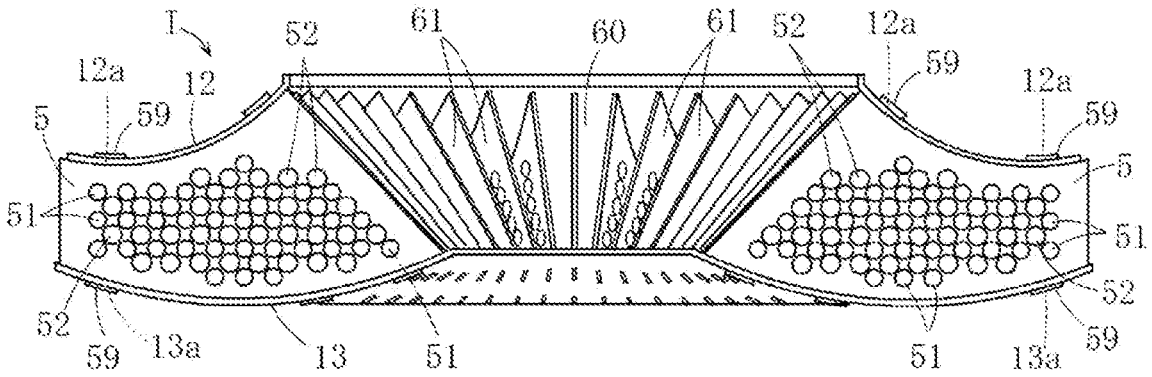
FIG. 4 is a sectional view taken along IV-IV in FIG. 3.

As shown well in FIGS. 2-4, the impeller I includes a front shroud 12, a rear shroud 13, and a plurality of blades 5.

The plurality of blades 5 are radially provided at intervals in the circumferential direction of the impeller I and extend substantially linearly in the radial direction of the impeller I, and the air blower A of this embodiment is configured as a radial fan. Inter-blade passages 61 are formed in between the plurality of blades 5, and a region closer to a center of the impeller I than the plurality of blades 5 is a central space portion 60 that communicates with the plurality of the inter-blade passages 61.

The front shroud 12 is in a hollow circular plate shape with an air intake opening formed in a center. The rear shroud 13 is in a circular plate shape and has substantially a same outer diameter as the front shroud 12. The plurality of blades 5 are interposed and fixed between the front shroud 12 and the rear shroud 13. For fixing, for example, as shown in FIG. 5, a plurality of protruding portions 59 for caulking provided at a front portion and a rear portion (an upper portion and a lower portion in FIG. 5) of each of the blades 5 are inserted into a plurality of holes 12*a*, 13*a* provided on the front shroud 12 and the rear shroud 13.

A central portion of the rear shroud 13 is mounted on a driving shaft 30 of the motor M with a nut member 31 or the like, such that the impeller I may rotate freely by the motor M. When the impeller I rotates, air outside of the casing 2 flows into the central space portion 60 from the air intake port 24, flows toward the radially outward side of the impeller I in a plurality of the inter-blade passages 61 out to the air passage 4, and then flows out of the casing 2 from the air blowing port 4*a*.

As best seen in FIG. 5 and (a) of FIG. 6 to (d) of FIG. 6, to reduce noise generated when air passes through the plurality of inter-blade passages 61, each of the blades 5 includes a plurality of first concavo-convex portions 51 and a plurality of second concavo-convex portions 52 (in FIG. 5, the first concavo-convex portions 51 are marked with dots, and the second concavo-convex portions 52 are not marked with dots).

Here, when a front surface and a rear surface of the blade 5 are respectively a first surface 5*a* and a second surface 5*b*, the first surface 5*a* side of the first concavo-convex portions 51 is a concave spherical surface with an appropriate curvature radius Ra (see (d) of FIG. 6), and the second surface 5*b* side is a convex spherical surface corresponding to the concave spherical surface. Preferably, the periphery of the concave spherical surface is rounded with an appropriate curvature radius Rb. Moreover, the curvature radius Rb is more preferably smaller than a plate thickness t. By appropriately reducing the curvature radius Rb, it is possible to sharpen a shape of the concave spherical surface and improve the dimple effect to be described later.

On the other hand, contrary to the first concavo-convex portion 51, the second concavo-convex portion 52 has a concave spherical surface on the second surface 5*b* side and a convex spherical surface on the first surface 5*a* side that is symmetrical with the first concavo-convex portion 51.

Specific examples of the sizes of the first and concavo-convex portions 51 and the second concavo-convex portions 52 will be described later, but with these sizes, dimple effect or an effect similar thereto to the airflow are possible. Moreover, concavo-convex portions are press-worked portions formed by press-working (step-pressing) each of the blades 5 made of metal from both sides in the thickness direction.

As shown in FIG. 5, the plurality of first concavo-convex portions 51 and the plurality of second concavo-convex portions 52 are provided in a staggered arrangement. More specifically, the first and concavo-convex portions 51 and the second concavo-convex portions 52 are arranged in rows respectively in the radial direction and width direction of the impeller I, and the rows of the first concavo-convex portions 51 and the rows of the second concavo-convex portions 52 are arranged alternately and displaced in both the radial direction and the width direction.

Moreover, the first and concavo-convex portions 51 and the second concavo-convex portions 52 are provided at a high density such that a total frontal view projection area a1 (not the area of solid portion of the concave spherical surface and the convex spherical surface) that is larger than a total area a2 of non-concavo-convex portions (planar regions) between the first and concavo-convex portions 51 and the second concavo-convex portions 52. Preferably, a total area (a1+a2) of the frontal view projection area of the first and concavo-convex portions 51 and the second concavo-convex portions 52 plus the non-concavo-convex portions interposed between the first and concavo-convex portions 51 and the second concavo-convex portions 52 is larger than half the area of each of the first and second surfaces 5*a* and 5*b* of the blade 5.

The air blower A is configured, for example, as a component of a combustion device C as shown in FIG. 7 and a hot water supply device WH including the combustion device C.

The combustion device C shown in the drawing includes a burner 8 housed in a case 80 and the air blower A mounted on the case 80 so as to supply combustion air to the burner 8. The hot water supply device WH includes a heat exchanger 9 that uses combustion gas generated by the burner 8 to heat hot water.

Next, the operation of the air blower A will be described.

First, when the impeller I is rotated by the motor M, as described above, the air outside flows into the central space portion 60 of the impeller I from the air intake port 24, passes the inter-blade passages 61 at the radially outward side to the air passage 4, and then flows out of the casing 2 from the air blowing port 4*a*.

On the other hand, each of the blades 5 of the impeller I includes the plurality of first concavo-convex portions 51 and the plurality of second concavo-convex portions 52, in which one side has a concave spherical surface and the other side has a convex spherical surface. The concave spherical surface brings forth a dimple effect as described below, resulting in a noise reduction effect.

That is, when the airflow flows along each of the blades 5, a small-scale turbulent flow is generated at where the concave spherical surfaces of the first and concavo-convex portions 51 and the second concavo-convex portions 52 are formed, and a boundary layer that becomes a laminar boundary layer flowing along the front surface and the rear surface, namely the first and second surfaces 5*a* and 5*b*, of each of the blades 5 easily becomes a turbulent boundary layer. Thus, the airflow along the first and second surfaces 5*a*, 5*b* of each of the blades 5 is less likely to separate from the first and second surfaces 5*a*, 5*b*, and regular occurrence of Karman vortices is also less likely. As a result, it is possible to reduce the noise of the airflow and improve the quietness of the air blower A.

On the other hand, the same effect as described above can be obtained at where the convex spherical surfaces of the first and concavo-convex portions 51 and the second concavo-convex portions 52 are formed, and the noise of the airflow can be reduced.

In this embodiment, since the first and concavo-convex portions 51 and the second concavo-convex portions 52 that bring forth the noise reduction effect described above are provided on both the front surface and the rear surface (the first and second surfaces 5*a* and 5*b*) of each of the blades 5, a fairly good noise reduction effect can be obtained.

The inventors trial-produced the same device as the air blower A, and conducted an experiment to find the relationship between the shapes and sizes of the first and concavo-convex portions 51 and the second concavo-convex portions 52 and the noise reduction effect. As a result, data of experimental results as illustrated in Table 1 below were obtained.

TABLE 1

| Depth d | 0.1 mm | 0.2 mm | 0.3 mm | 0.4 mm | 0.5 mm |
|---|---|---|---|---|---|
| Sound pressure level | 75.6 dB (A) | 75.5 dB (A) | 75.3 dB (A) | 74.8 dB (A) | 74.8 dB (A) |

The data in Table 1 shows a sound pressure level (feature A (auditory correction)) when a depth d of a deepest portion of the concave spherical surface gradually varies from 0.1 to 0.5, in which the plurality of first concavo-convex portions 51 and the plurality of second concavo-convex portions 52 have a concave spherical surface on one side and a convex spherical surface on the other side. The arrangement of the plurality of first concavo-convex portions 51 and the plurality of second concavo-convex portions 52 is the same as the arrangement shown in FIG. 5, and the configuration of each portion other than this and the operating conditions of the air blower A are the same. The plate thickness t of the blade 5 is 0.4 mm.

As shown in Table 1, when the depth d of the deepest portion of the concave spherical surface is 0.4 mm or more, the noise reduction effect is obviously better compared with that of less than 0.4 mm. Moreover, this experiment was carried out by variously changing a diameter D of the concave spherical surface when viewed from the front, and as a result, the same tendency as in Table 1 was obtained in the range of a circular shape having the diameter D of 1.0~3.0 mm in front view. Although not shown in Table 1, it was found that the size of the plate thickness t does not significantly affect the noise reduction effect.

Thus, when the first and concavo-convex portions 51 and the second concavo-convex portions 52 have a concave spherical surface on one side and a convex spherical surface on the other side, and the region of the concave spherical surface has a circular shape having the diameter D of 1.0 to 3.0 mm when viewed from the front, the depth d of the deepest portion is preferably 0.4 mm or more.

According to the air blower A of this embodiment, since the first and concavo-convex portions 51 and the second concavo-convex portions 52 provided on each of the blades 5 are symmetrical to each other, warping deformation and the like do not occur on each of the blades 5, and the shape of each of the blades 5 can be accurately maintained. For example, if only the first concavo-convex portions 51 are provided on each of the blades 5, warping deformation may occur on each of the blades 5, but such concern can be eliminated according to this embodiment.

FIG. 8 and (a) of FIG. 9 to (c) of FIG. 9 show another embodiment of the disclosure. In these diagrams, elements identical or similar to those in the above embodiment are denoted by the same reference numerals as in the above embodiment, and redundant description is omitted.

An impeller Ia shown in FIG. 8 includes a plurality of auxiliary blades 5A. Each of the auxiliary blades 5A has a length in the radial direction of the impeller Ia shorter than that of each of the blades 5, and is located toward the radially outward of the impeller Ia in between the plurality of blades 5 (the inter-blade passages 61). As a result, the region toward the radially outward of each of the inter-blade passages 61 is divided into two by each of the auxiliary blades 5A (further, unlike this embodiment, each of the inter-blade passages 61 may be divided into three or more regions by providing the plurality of auxiliary blades 5A in each of the inter-blade passages 61).

Although omitted in FIG. 8, as shown in Figure (a) of FIG. 9 to (c) of FIG. 9, each of the auxiliary blades 5A also includes the plurality of first concavo-convex portions 51 and the plurality of second concavo-convex portions 52. The plurality of first concavo-convex portions 51 and the plurality of second concavo-convex portions 52 provided on each of the auxiliary blades 5A are basically provided in a staggered arrangement similar to that shown in FIG. 5, although the total number are different.

The plurality of blades 5 of the impeller Ia are radially provided, and the inter-blade passages 61 are wider at the radially outward position of the impeller Ia. In this manner, when the air flows in the wide portion of the inter-blade passages 61, the amount of air that does not flow near the first and concavo-convex portions 51 and the second concavo-convex portions 52 provided on each of the blades 5 increases, which may increase noise. In contrast, according to this embodiment, in the wide portion, the air is made to flow near the first and concavo-convex portions 51 and the second concavo-convex portions 52 provided on the auxiliary blade 5A, and the noise reduction effect by the first and concavo-convex portions 51 and the second concavo-convex portions 52 can be obtained.

The disclosure is not limited to the content of the embodiments described above. The specific configuration of each portion of the air blower and the combustion device according to the disclosure may be changed in various ways within the intended scope of the disclosure.

Preferred specific examples of the shape and size of the first concavo-convex portions and the second concavo-convex portions are as described with reference to Table 1, but they are not limited thereto, and specific shape, size, total number, arrangement, etc. may be changed variously. In short, the first concavo-convex portions and the second concavo-convex portions in the disclosure are portions that function to reduce noise generated when air passes through the plurality of inter-blade passages, in which the first concavo-convex portions are only required that the first surface side of each blade of the impeller is concave and the second surface side is convex. Contrary to the first concavo-convex portions, the second concavo-convex portions are only required that the second surface side is concave and the first surface side is convex.

The first concavo-convex portions and the second concavo-convex portions may be formed by press-working a metal blade, but if the blade is made of resin, it may be formed integrally with the blade. The specific method for forming the first concavo-convex portions and the second concavo-convex portions is also not limited.

Although the air blower of the above-described embodiment is configured as a radial fan in which each of the plurality of blades extends linearly in the radial direction, instead of this, for example, it may be configured as a turbo fan in which each of the plurality of blades is curved.

The air blower according to the disclosure may be used for other purposes instead of being used as a component of a combustion device. In addition, the combustion device according to the disclosure is not limited to a hot water supply device, and may be configured as a combustion device for heating, for example, and the purpose and application of combustion are not limited.

What is claimed is:

1. An air blower, comprising:

a casing, having an air intake port and an air blowing port; and an impeller, housed in the casing and rotating, wherein the impeller comprises a plurality of blades arranged at intervals in a circumferential direction so as to form a plurality of inter-blade passages, and a region closer to a center than the plurality of blades serves as a central space portion communicating with the plurality of inter-blade passages, when the impeller rotates, air flowing into the central space portion through the air intake port passes through the plurality of inter-blade passages at a radially outward side of the impeller, and wherein to reduce noise generated when the air passes through the plurality of inter-blade passages, each of the blades comprises: a plurality of first concavo-convex portions, with a first surface side being concave and a second surface side on the other side being convex, from among a first surface and a second surface corresponding to a front surface and a rear surface of each of the blades; and a plurality of second concavo-convex portions, with the second surface side being concave and the first surface side being convex, contrary to the first concavo-convex portions, wherein each of the first concavo-convex portions and the second concavo-convex portions has a concave spherical surface on one side and a convex spherical surface on an opposite side, and a region of the concave spherical surface has a circular shape having a diameter of 1.0 to 3.0 mm when viewed from the front, and a depth of a deepest portion is 0.4 mm or more.

2. The air blower according to claim 1, wherein each of the blades is configured using a metal plate, and each of the first concavo-convex portions and the second concavo-convex portions is a press-worked portion.

3. The air blower according to claim 2, wherein the plurality of first concavo-convex portions and the plurality of second concavo-convex portions are arranged in a plurality of rows in a radial direction and a width direction of the impeller intersecting each other, and the rows of the first concavo-convex portions and the rows of the second concavo-convex portions are staggered and alternately arranged in the radial direction and the width direction.

4. The air blower according to claim 2, wherein a total frontal view projection area of the plurality of first concavo-convex portions and the plurality of second concavo-convex portions in each of the blades is larger than a total area of non-concavo-convex portions interposed between the plurality of first concavo-convex portions and the plurality of second concavo-convex portions.

5. The air blower according to claim 2, wherein a total frontal view projection area of the plurality of first concavo-convex portions and the plurality of second concavo-convex portions in each of the blades plus the non-concavo-convex portions interposed therebetween exceeds half of an area of each of the first and second surfaces of each of the blades.

6. The air blower according to claim 2, wherein the impeller further comprises: a plurality of auxiliary blades positioned at the radially outward side of the impeller in between the plurality of blades and dividing the inter-blade passages into a plurality of regions in the circumferential direction, and the plurality of first concavo-convex portions and the plurality of second concavo-convex portions are also provided on each of the auxiliary blades.

7. A combustion device, comprising a burner and an air blower for supplying gas for combustion to the burner, wherein the air blower according to claim 2 is configured as the air blower.

8. The air blower according to claim 1, wherein a total frontal view projection area of the plurality of first concavo-convex portions and the plurality of second concavo-convex portions in each of the blades plus the non-concavo-convex portions interposed therebetween exceeds half of an area of each of the first and second surfaces of each of the blades.

9. The air blower according to claim 1, wherein the impeller further comprises: a plurality of auxiliary blades positioned at the radially outward side of the impeller in between the plurality of blades and dividing the inter-blade passages into a plurality of regions in the circumferential direction, and the plurality of first concavo-convex portions and the plurality of second concavo-convex portions are also provided on each of the auxiliary blades.

10. A combustion device, comprising a burner and an air blower for supplying gas for combustion to the burner, wherein the air blower according to claim 1 is configured as the air blower.

11. The air blower according to claim 1, wherein the plurality of first concavo-convex portions and the plurality of second concavo-convex portions are arranged in a plurality of rows in a radial direction and a width direction of the impeller intersecting each other, and the rows of the first concavo-convex portions and the rows of the second concavo-convex portions are staggered and alternately arranged in the radial direction and the width direction.

12. The air blower according to claim 1, wherein a total frontal view projection area of the plurality of first concavo-convex portions and the plurality of second concavo-convex portions in each of the blades is larger than a total area of non-concavo-convex portions interposed between the plurality of first concavo-convex portions and the plurality of second concavo-convex portions.

13. An air blower, comprising:

a casing, having an air intake port and an air blowing port; and an impeller, housed in the casing and rotating, wherein the impeller comprises a plurality of blades arranged at intervals in a circumferential direction so as to form a plurality of inter-blade passages, and a region closer to a center than the plurality of blades serves as a central space portion communicating with the plurality of inter-blade passages, when the impeller rotates, air flowing into the central space portion through the air intake port passes through the plurality of inter-blade passages at a radially outward side of the impeller, and wherein to reduce noise generated when the air passes through the plurality of inter-blade passages, each of the blades comprises: a plurality of first concavo-convex portions, with a first surface side being concave and a second surface side on the other side being convex, from among a first surface and a second surface corresponding to a front surface and a rear surface of each of the blades; and a plurality of second concavo-convex portions, with the second surface side being concave and the first surface side being convex, contrary to the first concavo-convex portions, wherein the plurality of first concavo-convex portions and the plurality of second concavo-convex portions are arranged in a plurality of rows in a radial direction and a width direction of the impeller intersecting each other, and the rows of the first concavo-convex portions and the rows of the second concavo-convex portions are staggered and alternately arranged in the radial direction and the width direction.

14. A combustion device, comprising a burner and an air blower for supplying gas for combustion to the burner, wherein the air blower according to claim 13 is configured as the air blower.

15. The air blower according to claim 13, wherein each of the blades is configured using a metal plate, and each of the first concavo-convex portions and the second concavo-convex portions is a press-worked portion.

16. The air blower according to claim 13, wherein the impeller further comprises: a plurality of auxiliary blades positioned at the radially outward side of the impeller in between the plurality of blades and dividing the inter-blade passages into a plurality of regions in the circumferential direction, and the plurality of first concavo-convex portions and the plurality of second concavo-convex portions are also provided on each of the auxiliary blades.

17. An air blower, comprising:

a casing, having an air intake port and an air blowing port; and an impeller, housed in the casing and rotating, wherein the impeller comprises a plurality of blades arranged at intervals in a circumferential direction so as to form a plurality of inter-blade passages, and a region closer to a center than the plurality of blades serves as a central space portion communicating with the plurality of inter-blade passages, when the impeller rotates, air flowing into the central space portion through the air intake port passes through the plurality of inter-blade passages at a radially outward side of the impeller, and wherein to reduce noise generated when the air passes through the plurality of inter-blade passages, each of the blades comprises: a plurality of first concavo-convex portions, with a first surface side being concave and a second surface side on the other side being convex, from among a first surface and a second surface corresponding to a front surface and a rear surface of each of the blades; and a plurality of second concavo-convex portions, with the second surface side being concave and the first surface side being convex, contrary to the first concavo-convex portions, wherein a total frontal view projection area of the plurality of first concavo-convex portions and the plurality of second concavo-convex portions in each of the blades is larger than a total area of non-concavo-convex portions interposed between the plurality of first concavo-convex portions and the plurality of second concavo-convex portions, or wherein a total frontal view projection area of the plurality of first concavo-convex portions and the plurality of second concavo-convex portions in each of the blades plus the non-concavo-convex portions interposed therebetween exceeds half of an area of each of the first and second surfaces of each of the blades.

18. A combustion device, comprising a burner and an air blower for supplying gas for combustion to the burner, wherein the air blower according to claim 17 is configured as the air blower.

19. The air blower according to claim 17, wherein each of the blades is configured using a metal plate, and each of the first concavo-convex portions and the second concavo-convex portions is a press-worked portion.

20. The air blower according to claim 17, wherein the impeller further comprises: a plurality of auxiliary blades positioned at the radially outward side of the impeller in between the plurality of blades and dividing the inter-blade passages into a plurality of regions in the circumferential direction, and the plurality of first concavo-convex portions and the plurality of second concavo-convex portions are also provided on each of the auxiliary blades.

* * * * *